US009943103B1

(12) United States Patent
Marconi et al.

(10) Patent No.: US 9,943,103 B1
(45) Date of Patent: Apr. 17, 2018

(54) HANDS-FREE SUPPORT OF ELONGATED HAND-HELD ARTICLES METHOD AND APPARATUS

(71) Applicant: CIGAR COMPANION CONCEPTS, LLC, Little Neck, NY (US)

(72) Inventors: Stephen Marconi, Gold Canyon, AZ (US); Fou Sen Huang, Little Neck, NY (US)

(73) Assignee: Cigar Companion Concepts, LLC, Littel Neck, NY (US)

( * ) Notice: Subject to any disclaimer, the term of this patent is extended or adjusted under 35 U.S.C. 154(b) by 0 days.

(21) Appl. No.: 15/237,852

(22) Filed: Aug. 16, 2016

(51) Int. Cl.
*A24F 13/12* (2006.01)
*A24F 13/22* (2006.01)
*A63B 57/50* (2015.01)

(52) U.S. Cl.
CPC ..... *A24F 13/12* (2013.01); *A24F 13/22* (2013.01); *A63B 57/50* (2015.10)

(58) Field of Classification Search
None
See application file for complete search history.

(56) References Cited

U.S. PATENT DOCUMENTS

D385,940 S 11/1997 Justice
6,234,179 B1 5/2001 Alcaraz
6,363,941 B1 4/2002 Combs
6,796,913 B2 9/2004 Tummillo
7,000,617 B2 2/2006 Cervantes et al.
8,272,612 B2 9/2012 Thorpe
8,439,768 B1 5/2013 Shah
8,757,168 B2 6/2014 Wills
2004/0182402 A1 9/2004 Cervantes et al.
2006/0157071 A1 7/2006 Sheffield
2007/0235047 A1 10/2007 Long
2007/0251534 A1 11/2007 Raybum
2009/0082127 A1 3/2009 Donne
2011/0253154 A1 10/2011 Dolciato
2012/0266901 A1 10/2012 Powell et al.
2013/0267351 A1 10/2013 Nazelrod
2014/0060551 A1 3/2014 Zilka
2014/0209649 A1 7/2014 Schuster

FOREIGN PATENT DOCUMENTS

GB 690864 A * 4/1953 ..... A24F 13/22

* cited by examiner

*Primary Examiner* — Michael J Felton
(74) *Attorney, Agent, or Firm* — CARR Law Firm PLLC

(57) ABSTRACT

The present invention provides for a grasping device intended for use by golfers to hold a cigar above the ground. The device is constructed from a length of wire formed as two halves of a golfing tool. The two halves are intertwined into opposing halves, forming an actuator that may be squeezed to open a cigar grasper. An end is suited for use to repair ball marks and divots on a golf course.

20 Claims, 9 Drawing Sheets

HANDS-FREE SUPPORT OF ELONGATED HAND-HELD ARTICLES METHOD AND APPARATUS

BACKGROUND OF THE INVENTION

Field of the Invention

The present invention relates to a grasping device and golf tool and, more particularly, to a combination golf tool incorporating a cigar holder for use grasping and holding a cigar or other tobacco product on the greens of a golf course and golf divot tool.

Description of the Related Art

Millions of people play golf on a regular basis. In the U.S., playing golf is part of an almost weekly ritual for many individuals. For many, it is an important part of recreation, exercise, and fostering personal, business and corporate relationships.

Many golf enthusiasts enjoy smoking a cigar while golfing but lack a convenient means for storing a lit cigar in a clean, safe, and secure manner while using two hands for swinging a club and hitting the golf ball. Simply laying the lit cigar on the ground is undesirable, for many reasons, including for example that the cigar can get dirty, doing so creates an obvious fire danger, and a lit cigar can damage the golf course turf. Additionally, damp grass can wet the cigar, spoiling its aroma, taste, and proper burn characteristics.

It would be advantageous to provide a cigar holder that is useful to golfers.

SUMMARY

The present invention provides a grasping device intended for holding a cigar above the ground on a golf course.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning network communications, electro-magnetic signaling techniques, and the like, have been omitted inasmuch as such details are not considered necessary to obtain a complete understanding of the present invention, and are considered to be within the understanding of persons of ordinary skill in the relevant art.

Shown in FIGS. 1 through 4 is a cigar holder 100 primarily designed for golfers, but it will be apparent can be used by others to hold cigars as well as other objects. The holder 100 allows a golfer to clamp a lit cigar and take it onto the golf course instead of leaving it on the golf cart. The cigar holder 100 can be staked into the ground (keeping the cigar dry and off the grass) while the golfer executes a shot. The same tool can be used to repair ball marks, commonly referred to as divots.

A simple heavy gauge wire body may be used to form the cigar holder, with the cigar holder formed by intertwining a bent-in-half length of wire to provide a grasper, or gripping, portion and an actuator portion. The gripping and actuator portions may be formed by bending opposing halves of the body into semi-circular structures to form oval to circular structures when the opposing halves are intertwined together. While depicted with a symmetrical construction, the two halves of the body may be asymmetrical, and other geometric configurations can be formed rather than curves/circles or ovals.

Figure 1A:
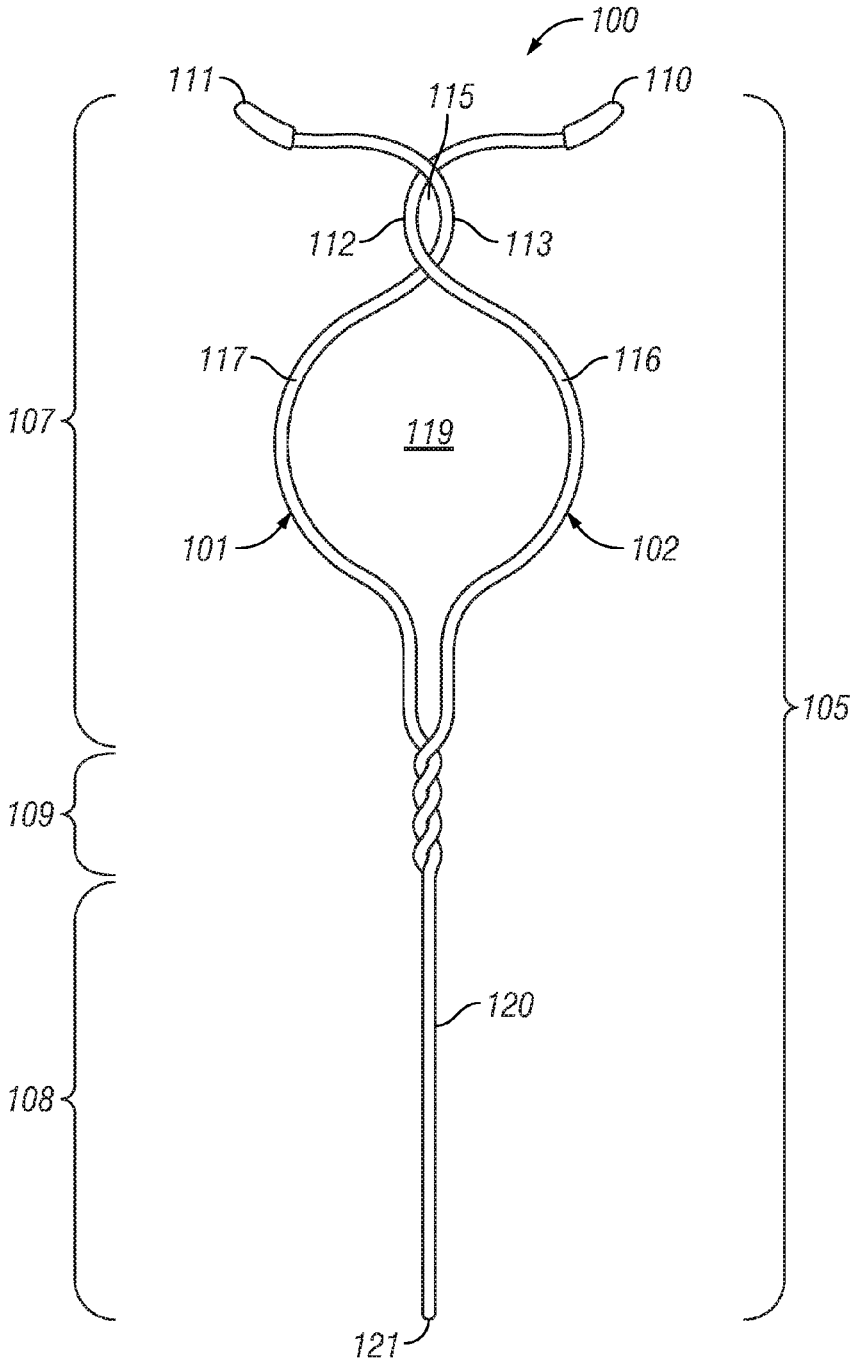
FIG. 1A illustrates a front view of an exemplary holder in an empty, non-actuated condition.

Turning now to FIG. 1A, the cigar holder 100 preferably may be constructed of 12 gauge galvanized steel wire to form a body 105 that may be bent into the configuration of holder 100, using a single piece of wire, with a vinyl cap on each of two top tips 110 and 111. Squeezing the spring force-biased actuator grips 116 and 117 may open two fingers 112 and 113 (semi-circular wire curves on each half of the body 105) forming a clamp with an adjustable grasper, or opening 115, between curved, central portions of the fingers 112 and 113. The actuator 119 may also be compressed (i.e., actuated) by squeezing together the tips 110 and 111 extending from the fingers 112 and 113 or, as already noted, squeezing the actuator grips 116 and 117. The two wire fingers 112 and 113 may be bent in generally opposite directions to form inwardly facing concave curved clamping surfaces (and outwardly facing convex curved surfaces) to form a clamp opening 115 between the fingers 112 and 113.

Actuator grips 116 and 117 are joined at a junction 109 at a lower end of the actuator 119. Portions of each of the actuator grips 116 and 117 form a leaf spring tending to hold the opening 115 in a relatively closed position. Resilient bending of leaf spring portions of the actuator, which bend to a greater extent at locations of each of the actuator grips 116 and 117 approaching the juncture, provides a spring force to close the fingers 112 and 113 around a cigar inserted in the opening 115 when the actuator 119 is released.

By squeezing together the actuator grips 116 and 117 and, alternatively or in combination, the two top tips 110 and 111, the concave gripping portions of the fingers 112 and 113 may be displaced apart, enlarging the adjustable opening 115, and allowing insertion into the opening 115 of a cigar or other object to be held by the holder 100. Release of the actuator grips 116 and 117 and the two top tips 110 and 111 allows a spring force to displace the fingers 112 and 113 apart from each other closing opening 115. As depicted, the two fingers 112 and 113 may be formed as semi-circular or generally curved bends of consistent radius or varying radius (not shown) in each of two halves 101 and 102 of body 105.

The two halves 101 and 102 of the body 105 may be symmetrical, such as the configuration shown in FIG. 1 or other configurations. In alternate configurations, the halves 101 and 102 of the body 105 may be asymmetrical, such as the configurations shown in FIGS. 5, 6, and 7 or other configurations.

A cigar may be inserted into the space, or opening 115, between the two fingers 112 and 113, when the fingers 112 and 113 are opened by compressing the actuator 119. After inserting the cigar, the actuator 119 may be released, drawing the concaved curved surfaces of the fingers 112 and 113 together against the cigar by spring force imparted by the leaf spring portions of the actuator 119. The pinching or compressive force imparted by the actuator 119 to the fingers 112 and 113 may assert spring tension and pressure against opposite sidewalls of the cigar by the two fingers 112 and 113 sufficient to hold the cigar, without denting, pinching or otherwise damaging the structure of the cigar. The spring compressive force imparted to the fingers 112 and 113, the size of the opening 115 between the fingers 112 and 113, and the curvature of the fingers 112 and 113 may be chosen to accommodate one or more of various cigar diameters.

The holder 100 may be constructed from a single length of wire, bent in half at one end 121. The length of wire is bent over onto itself at end 121, which forms the end 121 of a tine 120 having a shaft extending downwardly and away from the actuator 119. The two halves of the length of wire also form the two body halves 101 and 102, the actuator 119, and the grasping fingers 112 and 113. The two body halves 101 and 102 of the wire may be joined together by tightly twisting together lower portions of the two halves 101 and 102, forming wire junction 109. The twisted section, or wire junction 109, of the body 105 may be disposed below and adjacent to the actuator 119, and between the actuator 119 and the tine 120.

Although shown formed from one length of wire, the halves 101 and 102 of the holder 100 may also be constructed from two separate lengths of wire joined together at the wire junction 109 and welded or otherwise joined together at the end 121. The holder 100 may also be formed from a single piece of resilient plastic or two pieces of resilient plastic secured together at a location similar to the wire junction 109. It will be apparent that other materials may be used to form the holder 100 as well.

The body 105 may be constructed from a single piece of elongated resilient metal, such as copper, pewter, brass, bronze, silver, and the like. As already described, an acceptable elongated metal can comprise a length of heavy gauge wire, such as a length of 12 gauge galvanized steel. The body 105 may comprise bare metal along its length or may be coated or covered with a sheathing material (not shown) along at least a portion of its length. The sheathing material may be made from a pliant, soft or cushioning material, such as a soft pliable plastic, a soft pliable rubber material, or neoprene. Further, the body 105 may be formed using two equal lengths of metal secured together at a location similar to the wire junction 109.

In the orientation of FIG. 1, the body 105 comprises two vertical halves. The upper vertical half 107 may comprise the two terminal ends, or tips, 110 and 111 respectively. The tips 110 and 111 may be capped with vinyl (e.g., a soft pliable plastic material) sheaths. The fingers 112 and 113 above the opening 115 may be bent to an approximate 90° angle (preferably about between 45° to approximately 90°) outwardly from the vertical centerline of the body 105 to extend to tips 110 and 111. The bends in the metal forming the fingers 112 and 113 may be semi-circular hoops positioned so as to intertwine the two halves 101 and 102 and be displaced apart by manual force at actuator 119 and closed by spring tension. As discussed, a gripping spring force may be created by elastic bending of metal body 105 creating a spring tension biased toward opening the actuator 119, so that when grips 116 are squeezed and compressed against the spring force, actuator 119 closes becoming smaller in diameter. When displaced apart, the intertwined semi-circular hoops formed by the fingers 112 and 113 may enlarge the opening 115 to form a circular configuration for grasping an object, such as a cigar. In the resting (undeformed or unactuated) state shown in FIG. 1, the opening 115 is generally oval-shaped. The two semi-circular loops formed by fingers 112 and 113 comprise semi-circular holding loops or, more specifically, semi-circular cigar holding or grasping loops. Furthermore, the portions of the fingers 112 and 113 above the opening 115 and extending to the tips 110 and 111 may be used to support an object laid upon those portions of the fingers 112 and 113. Additionally, a soft, cushioning material (not shown) may be incorporated onto the inner concave portion of the opening 115 and thus provide a cushioned surface for receiving a cigar or other object, to reduce the chance of damaging the object.

The portions of wire forming fingers 112 and 113 at the opening 115 cross over each other above and below the opening 115. As shown, the finger 112 crosses over the finger 113 below the opening 115. However, above the opening 115, the finger 112 crosses under finger 113. In relative movement, the fingers 112 and 113 slide over at least a portion of their contacting surfaces. This configuration secures or at least limits movement of the fingers 112 and 113 laterally from the intended movement generally inwardly and outwardly with respect to the opening 115. Fingers 112 and 113 may be configured to cross over one another, above and below the opening 115, on the same side of the holder, as an alternative to the configuration shown. Alternatively, the fingers 112 and 113 may be configured to cross over on sides opposite those shown.

The semi-circular loops forming actuator grips 116 and 117 when compressed against the spring force provided by deformation of the wire forming the actuator 119, closes actuator 119 and enlarges the opening 115 to receive or release a cigar or other object. The fingers 112 and 113 and actuator grips 116 and 117 may be formed by bending the wire to form laterally displaced mirror-image "S" curves in the two halves 101 and 102.

The two halves 101 and 102 of the holder 100 may be joined by being twisted tightly together at the wire junction 109. The twisted, intertwined halves 101 and 102 may be secured at wire junction 109 to keep the two halves 101 and 102 in a functioning configuration and create a spring biasing force toward the opening 115 being in a relatively closed position (smaller in size). The spring force resists displacement of the actuator grips 116 and 117 and/or tips 110 and 111 toward one another to open the opening 115 further. In one example, this spring force applied to the fingers 112 and 113 at the opening 115 may be at least equal to the weight of a large cigar (17 to 19 grams) and typically will not cause damage to a cigar. The spring force may be determined as preferred, based primarily on the distance of the opening 115 from the junction 109. When the actuator grips 116 and 117 are gripped and compressed, the opening formed between the grips 116 and 117 may close and the opening 115 may further open. In addition to or as an alternative to twisting, the two halves 101 and 102 may be secured together at the junction 109 by welding, stamping (compressing the two halves 101 and 102 together), brazing, or casting (forming the body 105 as a single piece metal cast).

The lower vertical half 108 may comprise the bent wire forming a single shaft of tine 120. The shaft of tine 120 may terminate in a single tip or end 121, which may penetrate the ground to stake and hold the body 105 in a relatively upright, vertical orientation. The tine 120 may also be used as a golf tool for repairing divots on a putting green. Although depicted as a single tine, shaft of the tine 120 and the tine tip 121 in other configurations may be split (as either as an additional step in construction or as part of a cast or two-piece construction) to form two or more shafts along at least part of the length of the tine 120, to terminate in two or more tips 121.

Figure 1B:
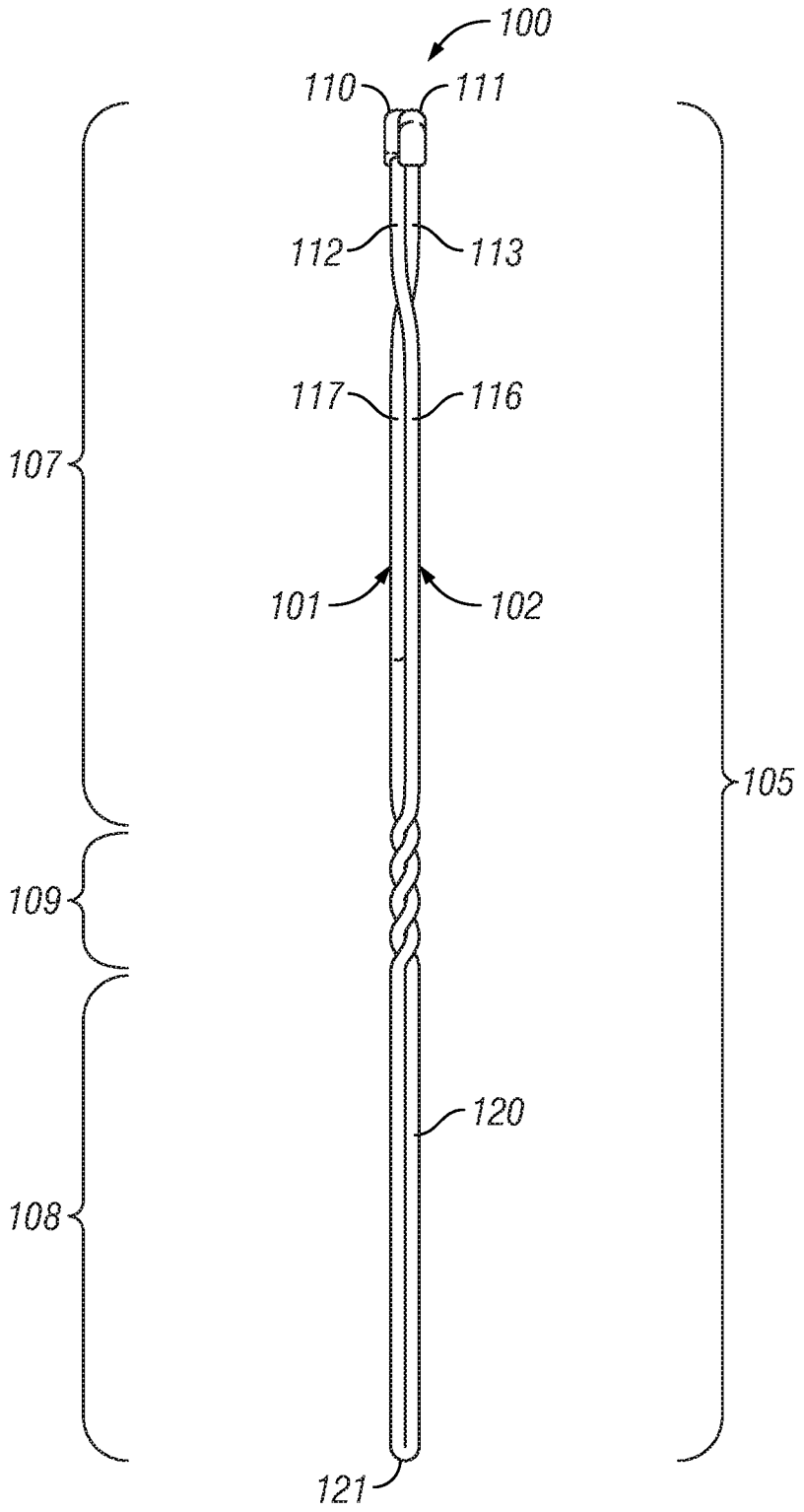
FIG. 1B illustrates a side view of the exemplary holder of FIG. 1A

Turning now to FIG. 1B, the reference number 100 depicts the identical cigar holder 100 turned 90° for a side-view. Structures with identical reference numerals of cigar holder 100 in FIGS. 1A and 1B correspond to identical depicted elements for FIG. 1A as described above with identical function, structure, and composition.

Figure 2:
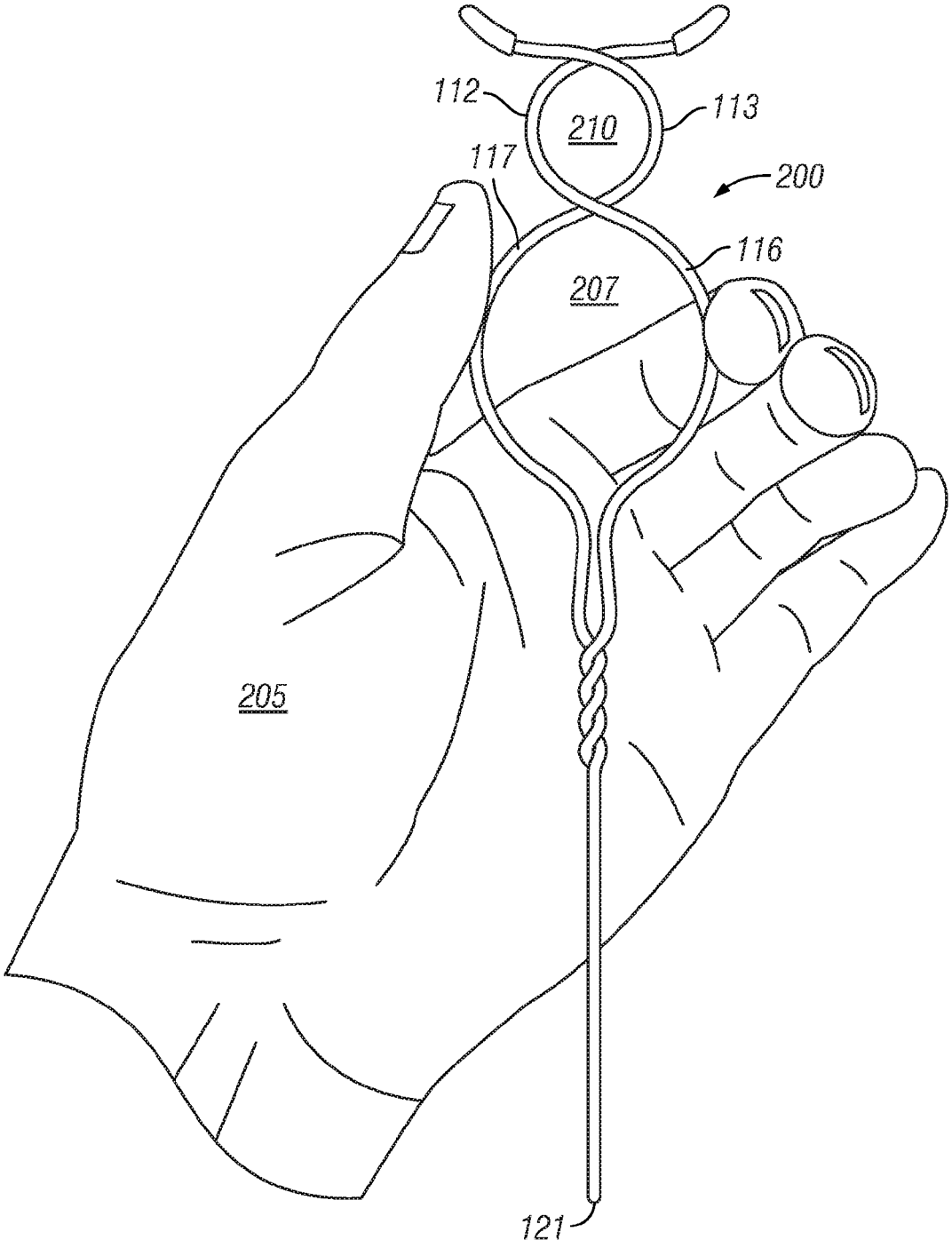
FIG. 2 illustrates the exemplary holder in a compressed, actuated condition, ready to receive a cigar or other object to be held.

Turning now to FIG. 2, the reference numeral 200 generally depicts another view of the cigar holder 100 being held by a user, with the actuator 119 compressed to enlarge opening 115 into a circular configuration.

In FIG. 2, a user hand 205 may compress actuator 207 to force the semi-circular holding loops forming fingers 112 and 113 apart and thus enlarge opening 115 into roughly circular, opening, or holding loop 210, thus increasing the circumference of opening 210 from an oval (opening 115) into a circular configuration (opening 210). When user hand 205 ceases compressing actuator 207, the spring force biasing movement of the fingers 112 and 113 apart may cause the opening 210 to close, decreasing the circumference of the opening 210, and toward the oval shape and smaller size of opening 115.

Figure 3:
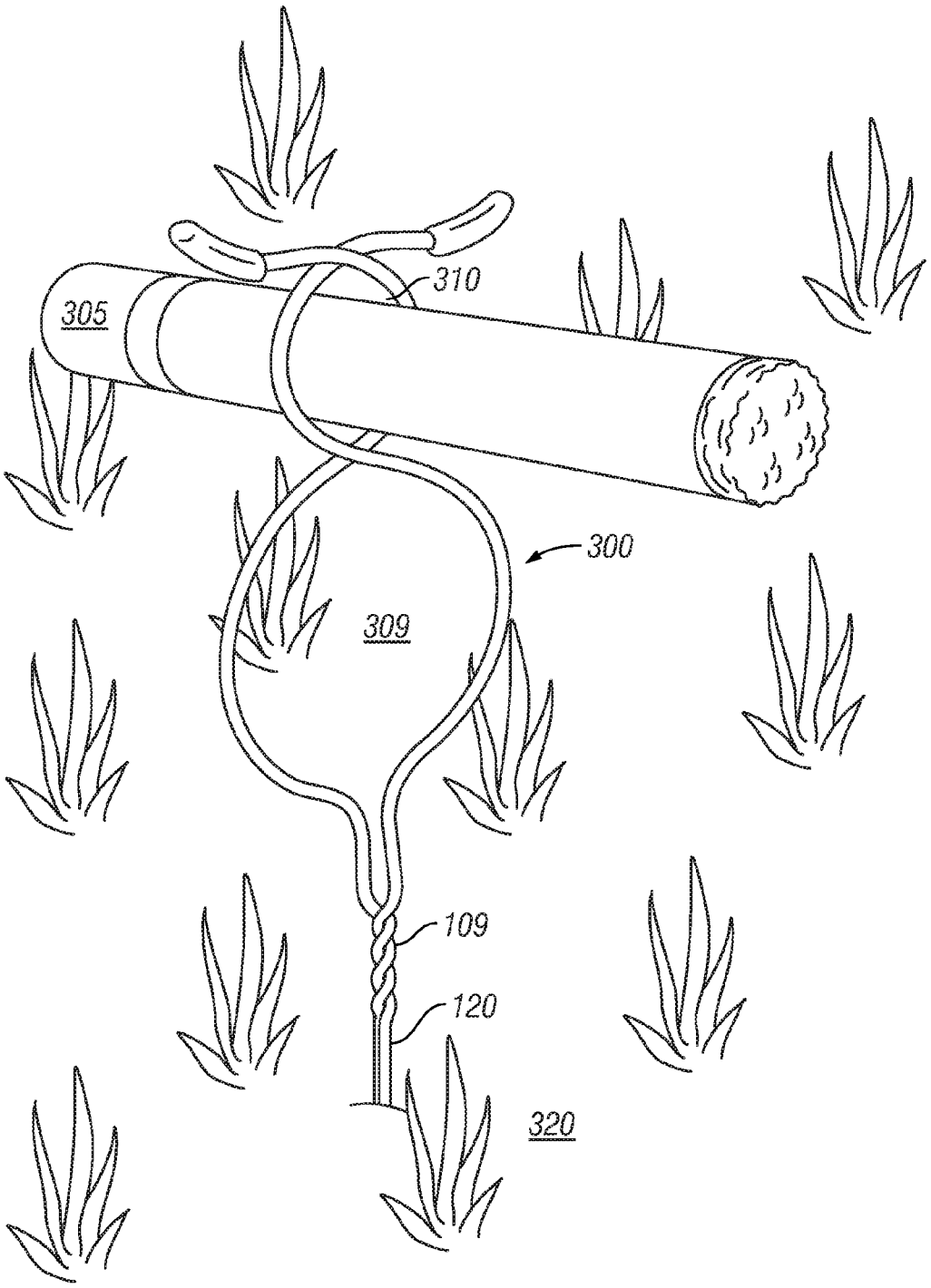
FIG. 3 illustrates the exemplary holder staked in the ground while holding a cigar.

Turning now to FIG. 3, the reference numeral 300 generally depicts another view of the holder 100 staked into the ground 320 for use. A user may insert the tip 121 (shown in FIG. 1) of the tine 120 into the ground 320 in a generally vertical configuration to elevate the opening 310 formed above the ground 320. The holder 300 may thus support an object gripped within the opening 310, such as a cigar 305, above the ground. The wire junction 109 may cause a spring force biased toward closing the opening 310 and opening the actuator 307, such that when a user compresses the actuator 307, the compression acts against the spring force to enlarge the opening 310 to the degree needed to release the cigar 305.

Figure 4:
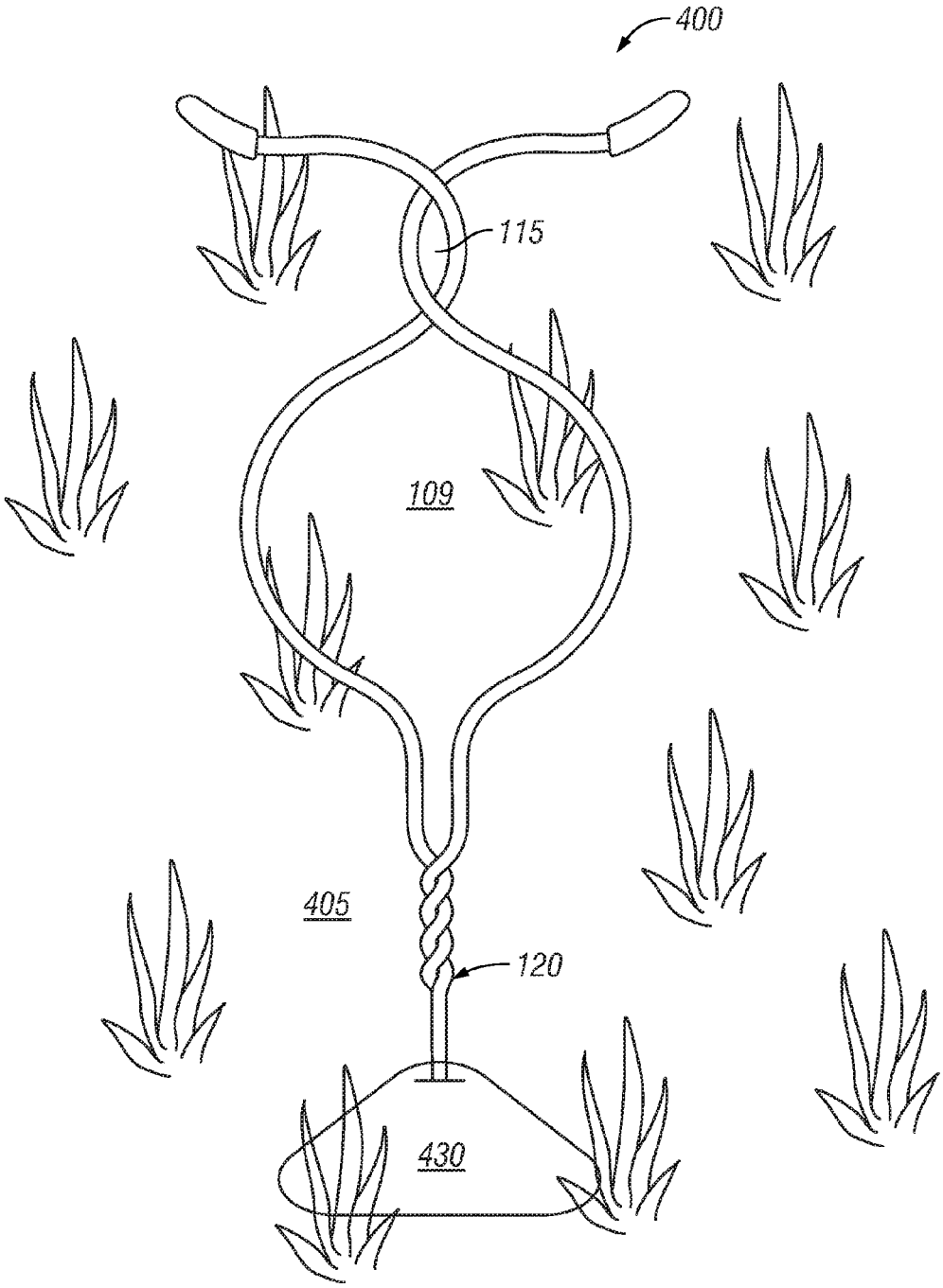
FIG. 4 illustrates use of a tine of the exemplary holder to repair a divot on a putting green.

Turning now to FIG. 4, the reference number 400 generally depicts the cigar holder 100 being used as a golfing tool to repair a divot.

As depicted in FIG. 4, a user may insert the holder 400 at an angle into the ground 405 so that the tine 120 passes underneath a divot 430. For this use, opening 115 is preferably empty. The apparatus 400 and tine 120 may be positioned so that the tine 121 may be leveraged against the ground beneath the divot 430 to press the divot back up toward the surrounding ground level, removing the depression forming the divot 430. The insertion may be at any convenient angle so that the tine 120 may elevate the divot 430 into a flat configuration, restoring an even golfing surface to the ground 405.

Figure 5:
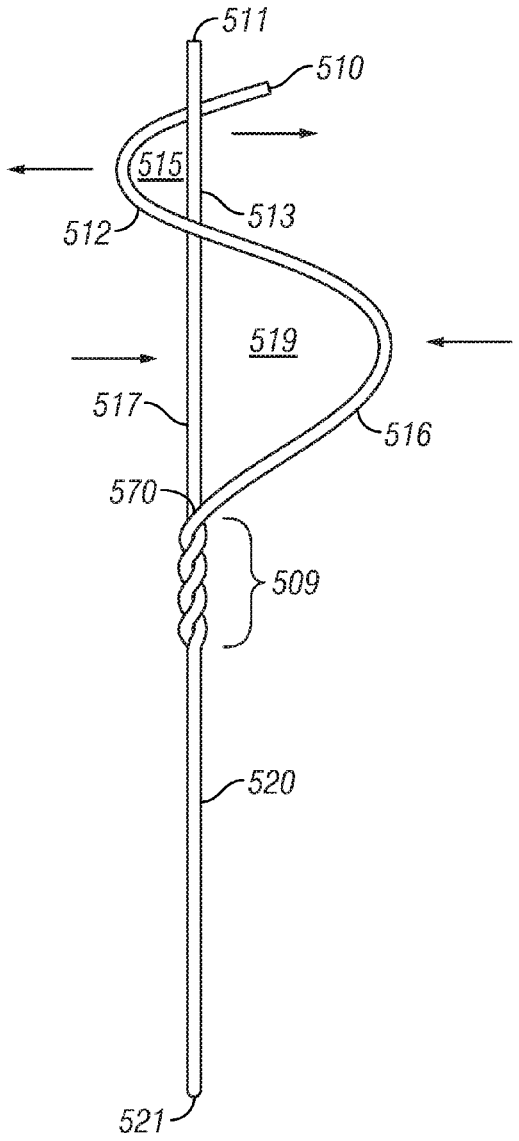
FIG. 5 illustrates a front view of a first alternative exemplary holder in an empty, non-actuated condition.
Figure 6:
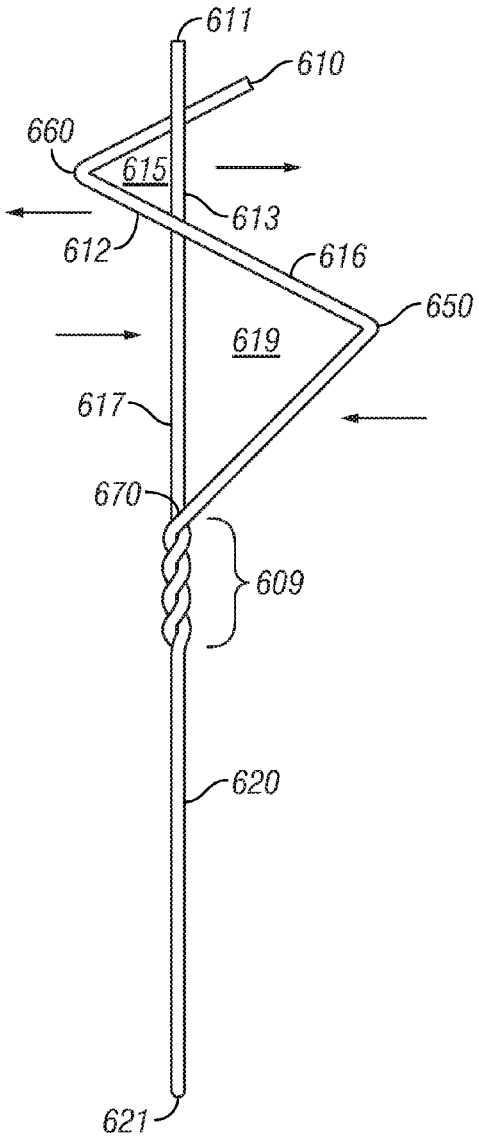
FIG. 6 illustrates a front view of a second alternative exemplary holder in an empty, non-actuated condition.
Figure 7:
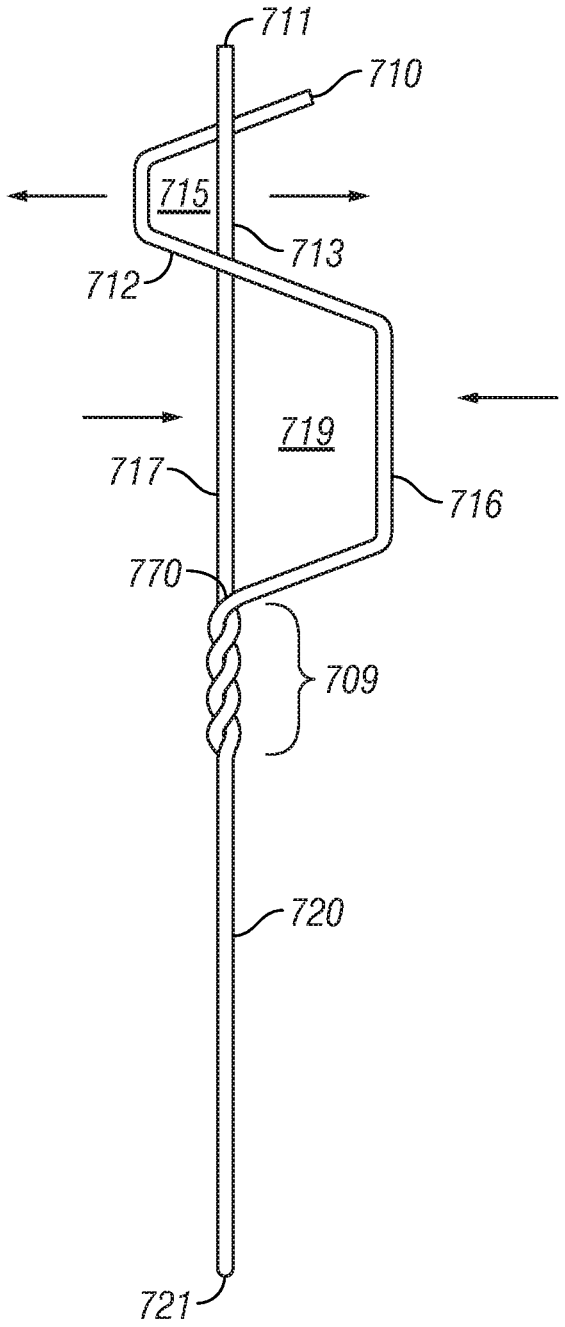
FIG. 7 illustrates a front view of a third alternative exemplary holder in an empty, non-actuated condition.

Shown in FIGS. 5 through 7 are alternative embodiments 500, 600, and 700 for a cigar holder. The cigar holders 500, 600, and 700 primarily differ in that only one length of wire is bent to form an actuator grip (516, 616 and 716) and finger (512, 612 and 712) for holding a cigar or other object. Also, the shape of the actuator grips and fingers differ. However, it will be apparent that further variations are possible without departing from the spirit of the invention, such as bending a portion one length of the bent wire to form an actuator grip and bending a portion of the other length of the bent wire to form one of the fingers forming an opening for gripping a cigar or other object.

Structures identified in FIGS. 6 and 7 by reference numerals ending with the same two digits as reference numerals in FIG. 5 (e.g., 509, 609, and 709; 515, 615 and 715; 517, 617 and 717; 519, 619 and 719; 520, 620 and 720, etc.) are substantially similar in structure, function, and composition, except to the extent described or illustrated differently herein or in FIGS. 6 and 7. Accordingly, such substantially similar structure may not be described again in connection with FIGS. 6 and 7 and the description of such structure in FIG. 5 or elsewhere (e.g., FIG. 1) herein is incorporated by reference as to the structure shown in FIGS. 6 and 7.

Turning now to FIG. 5, the reference number 500 generally depicts an alternative embodiment for a cigar holder 500 compared to cigar holder 100. The cigar holder 500 preferably may be constructed of 12 gauge galvanized steel wire that may be constructed using a single piece of wire. The cigar holder 500 may have a side tip 510, which may extend approximately between 45° and 90° outwardly from the vertical centerline of the holder 500 to the side, and a generally vertically extending tip 511. Both the side tip 510 and vertical tip 511 may be used to actuate an actuator 519 and tips 510 and 511 may each be covered with a vinyl sheath. An actuator grip 516 may be formed by a generally semi-circular curve in the wire. An actuator 519 may comprise a generally vertically extending portion 517 of the wire above the junction 509 and the actuator grip 516 that may be displaced toward and away from each other. A generally vertically extending finger 513 comprising a length of the portion 517 of the wire and a semi-circular, curved bend in the wire forming a finger 512 together form opposing surfaces of the opening 515. Each of the vertically extending portion 517 of the wire and the actuator grip 516 provide a spring force biasing the actuator 519 to return the opening 515 to an unopened position smaller than the cross-section of a cigar or other object to be held within the opening 515 by fingers 512 and 513. The actuator 519 may displace fingers 512 and 513 apart when the spring grip 516 and wire portion 517 are gripped and compressed.

The opening 515 may open to receive a cigar or other object. The actuator 519 may also be compressed (i.e., actuated) by squeezing the tips 510 and 511 and/or squeezing the actuator grip 516 and wire portion 517. The finger 512 may be curved outwardly to form the opening 515 between the fingers 512 and vertically oriented finger 513. The fingers 512 and 513 may be displaced apart, a cigar inserted in the opening 519, and the actuator 519 released to cradle a cigar or other object against the concaved portion of the finger 512 and the relatively straight finger 513.

The pinching or compressive force imparted by the actuator 519 to the fingers 512 and 513 may assert pressure against opposite sidewalls of a cigar by the fingers 512 and 513 sufficient to hold the cigar, without denting, pinching or otherwise damaging the structure of the cigar. The spring compressive force imparted to the fingers 512 and 513, the size of the opening 515, and the curvature of the finger 512 may be chosen to accommodate one or more of various cigar diameters. The holder 500 may be constructed in any of the various manners discussed with reference to the holder 100.

As shown, two halves of bent wire may be joined together by tightly twisting the wire together forming a wire junction 509. This twisted section, or wire junction 509, may be disposed below and adjacent to the actuator 519, between the actuator 519 and the tine tip 521 at the end of the tine 520. Although depicted as formed from one length of wire, the holder 500 may also be constructed from two separate lengths of wire joined together below the actuator 519 at wire junction 509. The tine 520 may be formed by one length of wire bent over onto itself at the tine tip 521, and the folded portions of the wire extending upwardly from the tip 521 to the actuator 519, while forming the tine 520. The holder 500 may also be formed from a single piece of resilient plastic or two pieces of resilient plastic secured together at the relative location of wire junction 509. It will be apparent that other materials may be used to form the holder 500 as well.

The holder 500 as depicted may be constructed from a single piece of elongated metal. As already described, an acceptable elongated metal can comprise a length of heavy gauge wire, such as a length of 12 gauge galvanized steel. The holder 500 can comprise bare metal or may be coated or covered with a sheathing material (not shown) along at least a portion of its length. This sheathing material can be made from a pliant, soft or cushioning material, such as a soft pliable plastic, a soft pliable rubber material, or neoprene. Besides the single piece of wire, the holder 500 can be formed from any elongated length of metal, such as copper, pewter, brass, bronze, silver, or the like. Additionally, a soft, cushioning material may be incorporated onto the wire surfaces forming the opening 515, to provide a cushioned surface for receiving a cigar or other object and reduce the chance of damage to the cigar or object.

The actuator grip 516 and finger 512 may overlap the wire portion 517 and finger 513. The finger 512 and actuator grip 516 may be formed by bending the wire to form an "S" curve in one half of the length of bent wire, as shown.

As depicted, the folded length of wire may be twisted tightly together at the wire junction 509 to join and connect the two halves of bent wire. The wire halves may be secured at wire junction 509 to provide a leaf spring force biasing the actuator 519 against compression that will enlarge the opening 515. In one configuration, this spring force exerted at the opening 515 may be equal to the weight of a large cigar (17 to 19 grams) and preferably will not cause damage to the cigar. When gripped and compressed at actuator grippers 516 and 517, the actuator 519 may close and the opening 515 may further open. In addition to or in the alternative to being twisted tightly, the folded lengths of wire may be secured together at the junction 509 by welding, stamping, brazing, casting, or other suitable means.

The tine 520 may terminate in a single tip 521, to be staked into the ground and position the holder 500 in a vertical orientation. The lower tine 520 and tip 521 may also be used a golf tool for repairing divots on a putting green. Although depicted as a single tine, the tine 520 could be split in two or more tines and tips (as either an additional step in construction or as part of a cast or two-piece construction) to form a split or double shaft along at least part of its length to terminate in two tips.

Turning now to FIG. 6, the reference number 600 generally depicts an alternative embodiment for a cigar holder 600 compared to cigar holder 100 and 500. As noted above, structures identified in FIGS. 6 and 7 by reference numerals ending with the same two digits as reference numerals in FIG. 5 (e.g., 509, 609, and 709; 515, 615 and 715; 517, 617 and 717; 519, 619 and 719; 520, 620 and 720, etc.) are substantially similar in structure, function, and composition, except to the extent described or illustrated differently in FIGS. 6 and 7. Accordingly, such substantially similar structure may not be described again in connection with FIGS. 6 and 7 and the description of such structure in FIG. 5 or elsewhere (e.g., FIG. 1) herein is incorporated by reference as to the structure shown in FIG. 6.

The cigar holder 600 as depicted varies from holder 500 by changing the geometric configuration of finger 612 and grip 616 compared to the corresponding structures in FIG. 5. Spring grip 616 may be formed by an approximately between 45° and 90° bend 650 in the wire (preferably approximately 60°) forming a triangular-shaped actuator 619 that moves toward or away from upper shaft 613. Actuator 619 may work to open finger 612 when spring grip 616 is gripped/compressed. The triangular-shaped opening 615 may also be formed by an approximately between 45° and 90° bend 660 in the wire (preferably approximately 60°), and may be so interposed as to move from the vertical plane of vertical tip 611 to open opening 615 to receive an object, specifically a cigar. The actuator 619 may also be closed (i.e., actuated) by squeezing the side tip 610 or squeezing the actuator grip 616. The finger 612 may extend outwardly to form an opening 615 between the finger 612 and upper shaft 613 when displacing the finger 612 apart to cradle a cigar or other object against the inner portion of the triangular shaped finger 612. As depicted, the bends 650 and 660 are approximate 60° bends in the wire to form the grip 619 and opening 615, creating an equilateral triangle for both opening 615 and actuator 619.

In essence, the finger 612 and grip 616 may be created by bending the wire to form a stylized angular "S" formed from two approximately 60° opposed bends 650 and 660 in the wire with an approximately 120° bend 670 at the end of the bottom "S" in one half of bent wire as shown. As depicted, the actuator 619 and grasper 615 may form approximate equilateral triangles, but other triangular configurations may be created by varying the angles of bends 650, 660, and 670.

Turning now to FIG. 7, the reference number 600 generally depicts an alternative embodiment for a cigar holder 600 compared to cigar holder 100 and 500. As noted above, structures identified in FIGS. 6 and 7 by reference numerals ending with the same two digits as reference numerals in FIG. 5 (e.g., 509, 609, and 709; 515, 615 and 715; 517, 617 and 717; 519, 619 and 719; 520, 620 and 720, etc.) are substantially similar in structure, function, and composition, except to the extent described or illustrated differently in FIGS. 6 and 7. Accordingly, such substantially similar structure may not be described again in connection with FIGS. 6 and 7 and the description of such structure in FIG. 5 or elsewhere (e.g., FIG. 1) herein is incorporated by reference as to the structure shown in FIG. 7.

The cigar holder 700 as depicted varies from holder 500 by changing the geometric configuration of finger 712 and grip 716 compared to the corresponding structures in FIG. 5.

Spring grip 716 may be formed by bends in the wire creating a trapezoidal quadrilateral in the wire forming actuator 719 that moves toward or away from upper shaft 713. Actuator 719 may work to open finger 712 when spring grip 716 is gripped/compressed. The opening 715 may also be formed as a trapezoidal quadrilateral bend in the wire, and may be so interposed as to move from the vertical plane of vertical tip 711 to open opening 715 to receive an object, specifically a cigar. The actuator 719 may also be closed (i.e., actuated) by squeezing and displacing the side tip 710 or squeezing the actuator grip 716. The finger 712 may extend outwardly to form an opening 715 between the finger 712 and upper shaft 713 when the finger 712 may be displaced apart and to cradle a cigar or other object against the inner portion of the finger 712. As depicted, the finger 712 and spring grip 716 may be formed as trapezoidal bends in the wire.

In essence, the finger 712 and grip 716 may be created by bending the wire into an angular stylized "S" of two interconnected trapezoids arranged end-to-end with an approximately 120° bend 670 at the end of the bottom "S" in one half of the bent wire as shown. As depicted, the actuator 619 and opening 615 may form approximate trapezoids, but other quadrilateral configurations may be created by varying the angles of bends 650, 660, and 670. Other geometric configurations are possible by the addition of more bends in the wire.

Figure 8:
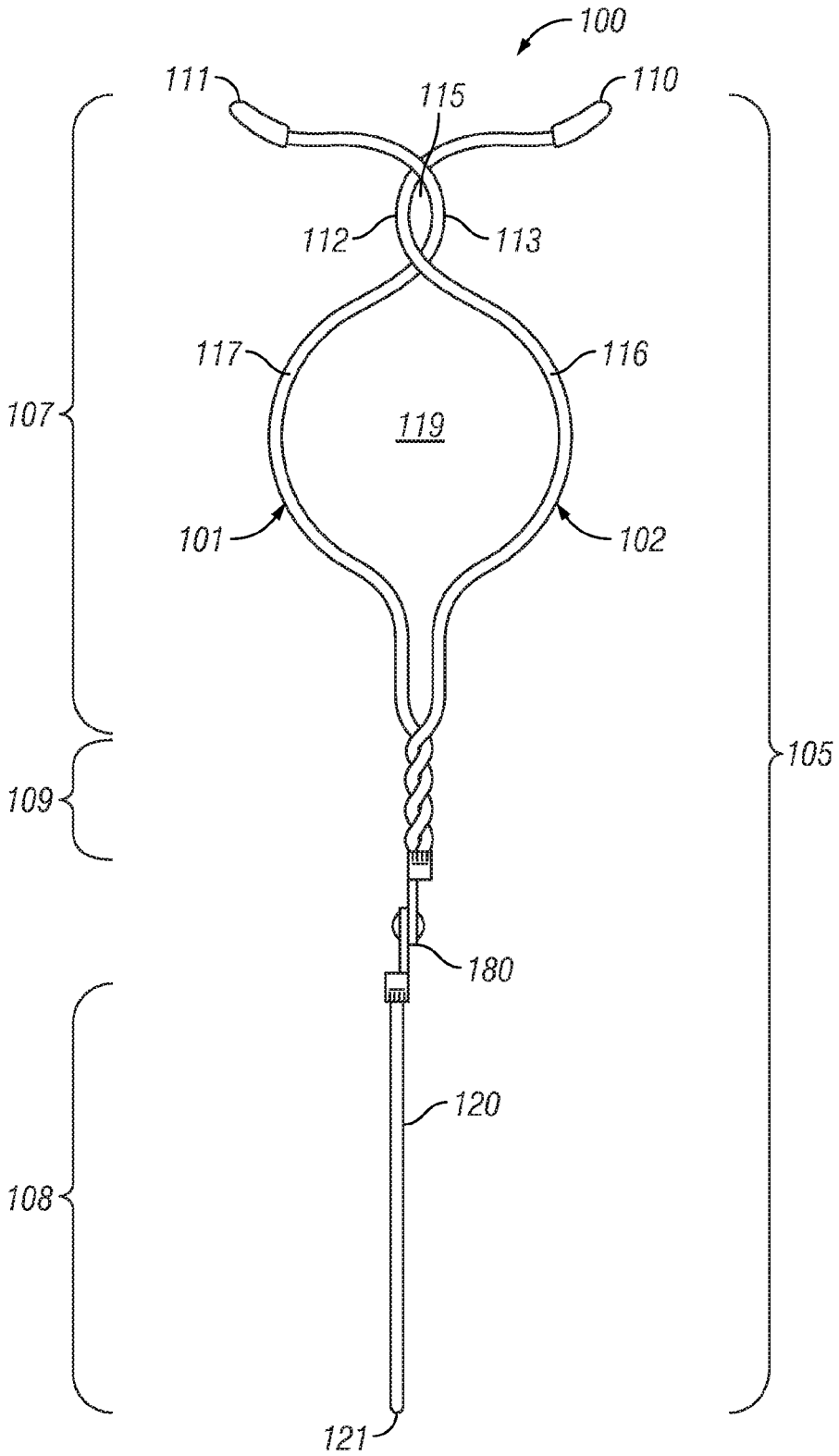
FIG. 8 illustrates a front view of a fourth alternative exemplary holder incorporating a hinge in an unfolded configuration.
Figure 9A:
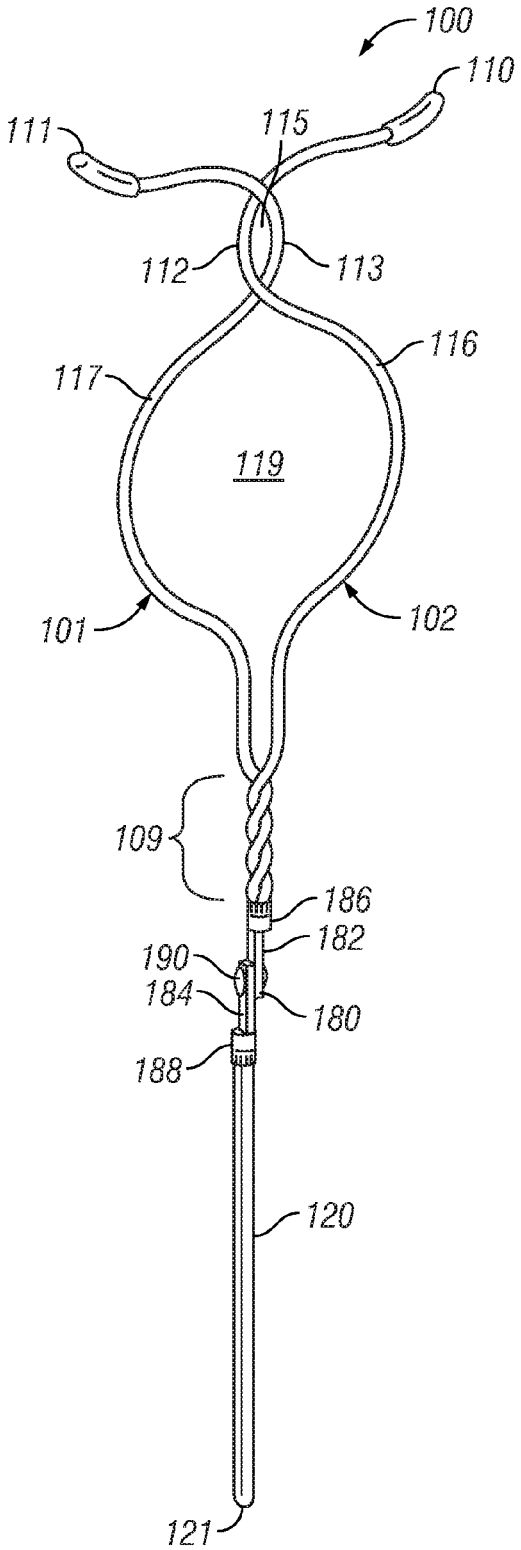
FIG. 9A illustrates a ¾ front view of the fourth alternative exemplary holder of FIG. 8.
Figure 9B:
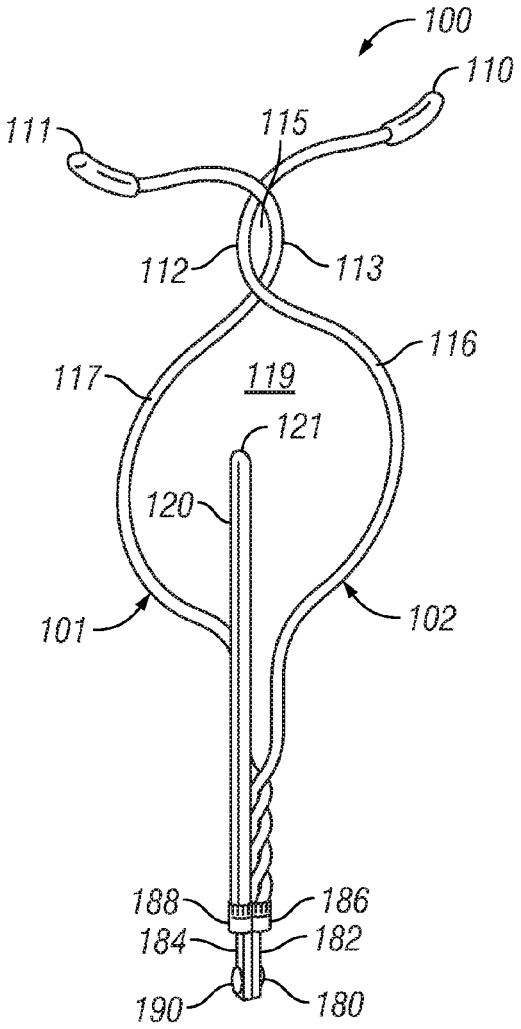
FIG. 9B illustrates a ¾ front view of the fourth alternative exemplary holder of FIG. 8 incorporating a hinge in a folded configuration.

Turning now to FIG. 8, the reference number 100 generally depicts an alternative embodiment for a cigar holder 100 compared to cigar holder 100 in FIG. 1A. Structures identified in FIGS. 1A and 8 by identical reference numerals may be identical in structure, function, and composition. FIG. 8 is identical in its depiction of cigar holder 100 but for the addition of a hinge 180 interposed between tine 121 and junction 109 along shaft 120. Hinge 180 enables the cigar holder 100 to fold into a more compact configuration for easy stowage and transport, either in a side pocket of a golf bag or in a person's pocket Turning now to FIGS. 9A and 9B, FIG. 9A depicts the cigar holder 100 of FIG. 8 in a ¾ front view in the identical extended configuration. Structures identified in FIGS. 1A, 8, 9B, and 9B by identical reference numerals may be identical in structure, function, and composition. As depicted, FIGS. 8 and 9A are identical, except for the change in perspective. FIG. 9B is identical in perspective, but FIG. 9B depicts cigar holder 100 in a folded configuration, with the shaft 120 folded upward at hinge 180. In FIGS. 8 and 9A, the hinge 180 is unfolded with the tine 121 extending downward, while in FIG. 9B, the hinge is folded with the tine 121 extending up from the hinge 180 and folded along the upper portion of the cigar holder 100 above junction 109.

As depicted, hinge 180 may be interposed and attached to vertical halves of the shaft 120 so that the arms 182 and 184 of the hinge 180 may be offset from the centerline of the shaft 180 and the junction 109 toward each other to allow the shaft 120 to rotate and fold upon itself and rest alongside each other at junction 109 with tine 121 pointing up. As shown, the arms 182 and 184 have adjacent surfaces generally aligned with a surface of the junction 109 below the half 101 of the holder 100, although the adjacent surfaces may also be aligned with a surface of the junction 109 below the half 102. Such alignment facilitates folding of the hinge and tine 120 with reduced or no interference with the junction 109.

As depicted, the hinge 180 may comprise two arms 182 and 184 extending from cupped members 186 and 188. The arms 182 and 184 are coupled together for relative rotation by a fastener 190 allowing hinge 180 to move between an open position shown in FIGS. 8 and 9A and a folded position shown in FIG. 9B. The ends of fastener 190 may be stamped to form rivet heads larger than the openings through which the fastener shaft passes in the arms 182 and 184, to secure the fastener to the hinge 180. The fastener 190 may be stamped to compress the ends of the fastener 190 against the respective arms 182 and 184 to provide an interference fit between the arms 182 and 184, as well as between the fastener 190 and the arms 182 and 184. The interference fit resists rotation of the hinge 180 between the positions shown in FIGS. 8, 9A and 9B, allowing the hinge 180 to be rotated to a desired position and friction between the arms 182 and 184 holding the hinge 180 in the desired position.

The cupped member 188 of the hinge 180 may be placed over the upper end of the shaft 120 and crimped to secure hinge 180 to shaft 120. In turn, the other cupped member 186 may be placed over the lower end of the junction 109 and crimped to secure hinge 180 to the junction 109. This offset configuration of the arms 188 and 186 of the hinge 180 allows folding of the cigar holder 100 into a shorter, more compact configuration, with the shaft 120 and junction 109 positioned together in contact and offset from each other.

Rather than crimping the hinge 180 to shaft 120 and junction 109, hinge 180 may be attached by other means such as welding, soldering, brazing, stamping, and the like. Other configurations of the hinge 180 could be utilized to allow folding of the cigar holder 100. For example, hinge 180 may also incorporate a locking mechanism (not shown) to lock hinge 180 in an open, unfolded configuration; a closed, folded configuration; or in both the open or closed configuration. Yet another possible configuration is a sliding shaft 120 so that the cigar holder 100 may be placed in an extended configuration by sliding the shaft 120 out and away from junction 109, or a compact configuration by sliding shaft 120 in and toward junction 109, allowing for sliding movement of the shaft 120 toward and away from the junction 109.

As depicted, the cigar holder 100 may be cut into and upper and a lower portion at approximately the lowermost portion of junction 109, separating shaft 120 from junction 109. The two portions of the cigar holder 100 thus formed may then be securely attached to each other by the hinge 180 interposed between the two severed portions of the cigar holder 100, as shown in FIGS. 8, 9A and 9B. Alternatively, the hinge 180 may be similarly positioned at other locations along shaft 120 or junction 109.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A cigar holding apparatus, comprising:

a first length of wire;

a second length of wire;

wherein the first and second lengths of wire are joined together at a wire junction;

wherein at least an actuator portion of the first length of wire is laterally spaced from the second length of wire;

wherein the actuator portion of the first length of wire is displaceable towards the second length of wire, against a gripping spring force provided by elastic bending of one or both of the first and second lengths of wire;

wherein the first length of wire comprises a first cigar grasper portion;

wherein the first cigar grasper portion is configured to be displaced from the second length of wire when the actuator portion of the first length of wire is displaced towards the second length of wire to allow a cigar to be placed between the first cigar grasper portion and a portion of the second length of wire;

wherein, when the actuator portion of the first length of wire is displaced away from the second length of wire under the gripping spring force, the first cigar grasper portion is displaced by a cigar gripping force toward the second length of wire to grip a cigar against at least a portion of the second length of wire; and wherein a portion of one or both of the first and second lengths of wire extends beyond the wire junction in a direction away from the actuator portion of the first length of wire to terminate in a tine.

2. The apparatus of claim 1, wherein the tine is configured to pierce and be inserted into the ground and support the first cigar grasper portion a distance from the ground.

3. The apparatus of claim 1, wherein a terminus end of the first length of wire can be used as a single tine golf tool for repairing divots.

4. The apparatus of claim 1, wherein the cigar gripping force exerts a force of at least 17 to 19 grams.

5. The apparatus of claim 1, wherein the wire junction secures the first length of wire and second length of wire by twisting said lengths tightly together.

6. The apparatus of claim 1, wherein the wire junction secures the first length of wire and second length of wire together by at least one of:

a) welding;

b) stamping;

c) brazing; or d) casting.

7. The apparatus of claim 1, wherein the first and second lengths of wire comprise galvanized steel, copper, brass, pewter, bronze, or silver.

8. The apparatus of claim 1, wherein at least a portion of the first and second lengths of wire is covered by a soft cushioning material.

9. The apparatus of claim 8, wherein the soft cushioning material comprises at least one of:

a) a soft pliable plastic material;

b) a soft pliable rubber material;

c) neoprene; and d) vinyl.

10. A grasping device intended for holding a cigar above the ground, comprising:

a first half of a length of wire;

a second half of the length of wire;

wherein the first and second halves of wire are formed by bending the length of wire in half and joining together at a wire junction;

wherein at least an actuator portion of the first half of the length of wire is laterally spaced from the second half of the length of wire;

wherein the actuator portion is displaceable towards the second half of the length of wire, against a gripping spring force provided by elastic bending of one or both of the first and second halves of the lengths of wire;

wherein at least the first half of the length of wire comprises a first cigar grasper portion;

wherein the first cigar grasper portion is configured to be displaced from the second length of wire when the actuator portion of the first half of the length of wire is displaced towards the second half of the length of wire to allow a cigar to be placed between the first cigar grasper portion and a portion of the second half of the length of wire;

wherein, when the actuator portion of the first half of the length of wire is displaced away from the second half of the length of wire under the gripping spring force, the first cigar grasper portion is displaced by a cigar gripping force toward at least a portion of the second length of wire; and a tine comprising a portion of one or both halves of the first and second lengths of wire extends beyond the wire junction, the tine having an end portion comprising a tip pointing in a direction away from the actuator portion.

11. The apparatus of claim 10, wherein the first cigar grasper portion exerts a grasping tension of at least 17 to 19 grams.

12. The apparatus of claim 10, wherein first and second halves of wire are secured together by twisting said halves tightly together at the wire junction; and a hinge is interposed on a shaft of the apparatus below the junction.

13. The apparatus of claim 10, wherein the first and second halves of wire comprises a wire junction along a length of each of the two halves secured together by at least one of:

a) twisting;

b) welding;

c) stamping;

d) brazing; or e) casting.

14. The apparatus of claim 13, wherein an end of the portion of one or both halves of the first and second lengths of wire that extends beyond the wire junction in a direction away from the actuator portion forms a single-tine golf tool.

15. The apparatus of claim 10, wherein the wire comprises a metal such as galvanized steel, copper, brass, pewter, bronze, or silver.

16. The apparatus of claim 10, wherein at least portions of the wire are covered by a soft cushioning material.

17. The apparatus of claim 10, wherein the two halves include at least one laterally displaced "S" curves forming the cigar grasper portion and the actuator portion.

18. The cigar holding apparatus of claim 1, wherein the first and second lengths of wire form a body which substantially occupies a single plane.

19. A combined cigar holding apparatus and golf tool, comprising:

a first length of wire;

a second length of wire;

wherein the first and second lengths of wire are joined together at a wire junction;

wherein at least an actuator portion of the first length of wire is laterally spaced from the second length of wire;

wherein the actuator portion of the first length of wire is displaceable towards the second length of wire, against a gripping spring force provided by elastic bending of one or both of the first and second lengths of wire;

wherein the first length of wire comprises a first cigar grasper portion;

wherein the first cigar grasper portion is configured to be displaced from the second length of wire when the actuator portion of the first length of wire is displaced towards the second length of wire to allow a cigar to be placed between the first cigar grasper portion and a portion of the second length of wire;

wherein, when the actuator portion of the first length of wire is displaced away from the second length of wire under the gripping spring force, the first cigar grasper portion is displaced by a cigar gripping force toward the second length of wire to grip a cigar against at least a portion of the second length of wire; and wherein the first and second lengths of wire form a body which substantially occupies a single plane extending through the first and second lengths of wire.

20. The combined cigar holding apparatus and golf tool of claim 19, wherein the wire junction further comprises a portion of each of the first and second lengths of wire secured together and wherein the wire junction is formed by at least one of:

a) twisting;
b) welding;
c) stamping;
d) brazing; or
e) casting.

* * * * *